US006984084B2

(12) United States Patent
Ng et al.

(10) Patent No.: US 6,984,084 B2
(45) Date of Patent: Jan. 10, 2006

(54) IMAGING MEDIA TRAY AND METHOD

(75) Inventors: Wei Kwan Ng, Singapore (SG); Chin Long Wee, Singapore (SG); Sanil Kumar Parammal, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/813,762

(22) Filed: Mar. 30, 2004

(65) Prior Publication Data

US 2005/0219343 A1 Oct. 6, 2005

(51) Int. Cl.
*B65H 1/04* (2006.01)

(52) U.S. Cl. ..... 400/624; 271/145; 271/162

(58) Field of Classification Search ..... 271/162, 271/164, 121; 400/624, 625, 628, 636, 579
See application file for complete search history.

(56) References Cited

U.S. PATENT DOCUMENTS 5,201,511 A * 4/1993 Kim ..... 271/127
5,806,844 A * 9/1998 Bailey et al. ..... 271/145
6,116,589 A * 9/2000 Bortolotti ..... 271/121
6,693,728 B1 * 2/2004 Kinoshita et al. ..... 358/296

FOREIGN PATENT DOCUMENTS

JP 05004760 A * 1/1993
JP 08091589 A * 4/1996
JP 09002671 A * 1/1997

* cited by examiner

*Primary Examiner*—Daniel J. Colilla

(57) ABSTRACT

An imaging media tray for an imaging system such as a printer is provided that includes a media cassette having a sloping end wall, and a blocking means. The blocking means has a blocking mode adapted to prevent imaging media from moving up the sloping end wall when the media cassette is being inserted into the imaging system and an inactive mode to facilitate transmission of the media to the imaging system. The blocking means adopts the inactive mode after the media cassette is inserted into the imaging system. A method for preventing imaging media from moving up the sloping end wall when the media cassette is being inserted into the imaging system is also disclosed.

20 Claims, 6 Drawing Sheets

IMAGING MEDIA TRAY AND METHOD

FIELD OF THE INVENTION

The present invention relates generally to loading imaging media in imaging systems such as printers. More particularly the present invention relates to an imaging media tray and a method of use thereof.

BACKGROUND OF THE INVENTION

An imaging system such as a printer typically includes an imaging media tray comprising a chassis and a cassette which holds the imaging media such as a stack of paper. To assist transmission of the media from the cassette to the printer, a rear wall of the cassette may be formed with a sloping rather than a straight or perpendicular surface. This allows a simplified transmission mechanism to be used comprising a single roller to push the media back against the sloping surface which then deflects the media up the wall and into the printer. Loading of the imaging media into the media tray is accomplished by removing the cassette from the chassis. After the imaging media is placed into the cassette, the cassette is slotted back into the chassis. When this action is performed rapidly there is a tendency to "slam" the cassette into the chassis. Due to the sloping rear surface and the inertia of the media especially when the cassette is inserted with too much force, there is a tendency for the media to ride up the sloping surface giving rise to jamming of the media during transmission thereof to the printer.

SUMMARY OF THE INVENTION

An object of the present invention is to provide a blocking apparatus that prevents the media from moving up the slope even when a cassette is inserted above a certain force.

According to one aspect of the present invention there is provided an imaging media tray for an imaging system, said media tray including a media cassette having a sloping end wall, and a blocking means having a blocking mode adapted to prevent imaging media from moving up said sloping end wall at least when said media cassette is being inserted into said imaging system, and an inactive mode to facilitate transmission of said media to said imaging system, wherein said blocking means adopts said inactive mode after said media cassette is inserted into said imaging system.

According to a further aspect of the present invention there is provided in an imaging media tray including a media cassette having a sloping end wall, a method for preventing imaging media from moving up said sloping end wall at least when said media cassette is being inserted into an imaging system, said method including the steps of:

providing a blocking means having a blocking mode and an inactive mode;

setting said blocking means to said blocking mode at least when said media cassette is being inserted into said imaging system; and setting said blocking means to said inactive mode after said media cassette is inserted into said imaging system to facilitate transmission of said media to said imaging system.

These and other objects and advantages of the present invention will no doubt become obvious to those of ordinary skill in the art after having read the following detailed description of a preferred embodiment as illustrated in the drawing figures.

DESCRIPTION OF THE DRAWINGS

A preferred embodiment of the present invention will now be described with reference to the accompanying drawings wherein.

DETAILED DESCRIPTION OF THE PREFERRED EMBODIMENT

Figure 1:
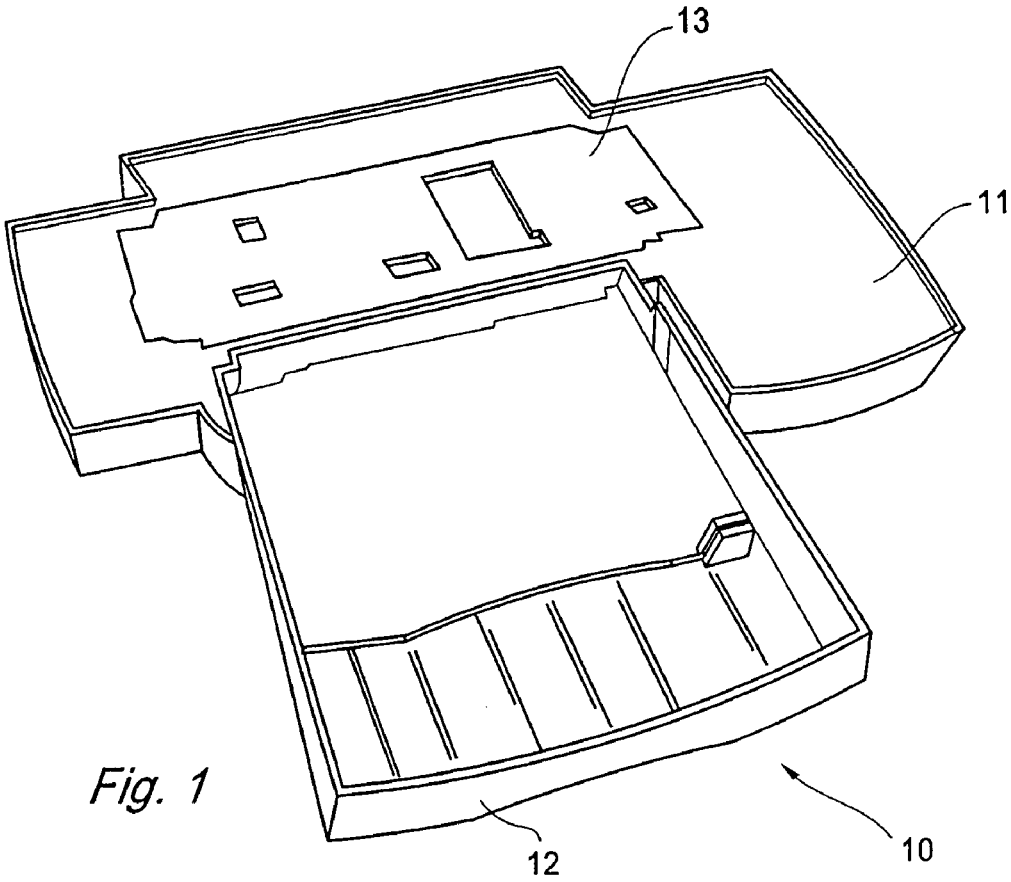
FIG. 1 shows a perspective view of a media tray including a chassis and cassette.
Figure 2:
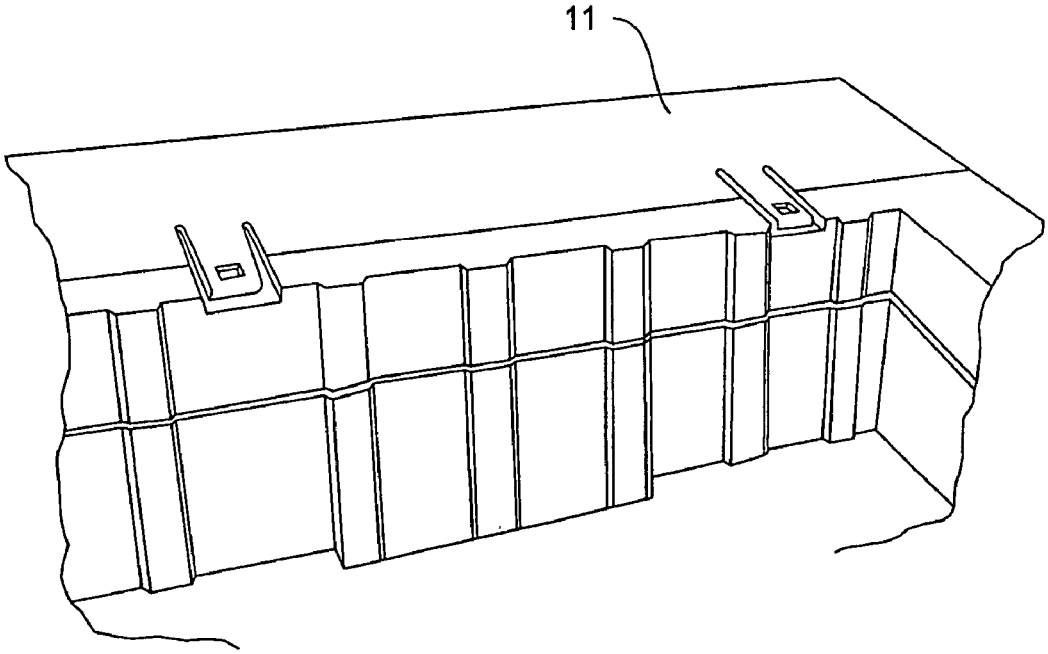
Fig. 2 (Prior Art)
FIG. 2 shows a prior art tray body with the chassis removed.
Figure 3:
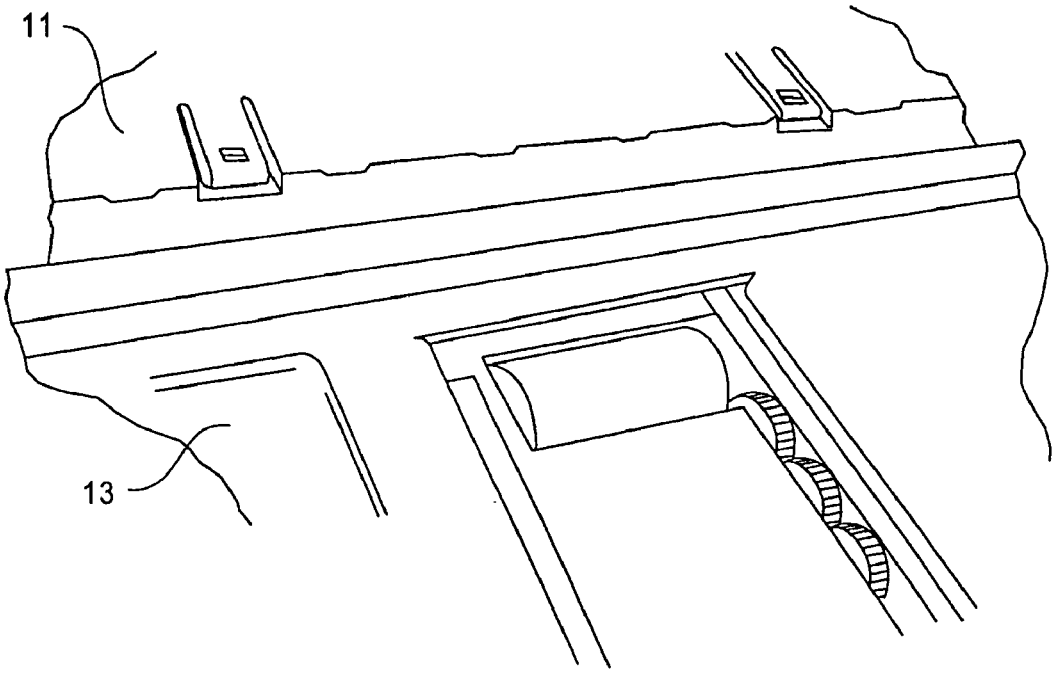
Fig. 3 (Prior Art)
FIG. 3 shows the tray body of FIG. 2 with the chassis inserted.

FIG. 1 shows a media tray 10 for an imaging system such as an inkjet printer, including a tray body 11, a cassette 12 and a chassis 13. Cassette 12 is adapted to hold imaging media such as a stack of paper. The media (paper) is transferred from cassette 12 to the associated printer via a transmission mechanism associated with chassis 13. The transmission mechanism typically includes means for lifting the media above the rear wall of the cassette 12 to facilitate transfer of the media from the cassette 12 to the printer. The lifting means is required to lift the media above the straight perpendicular rear wall that would otherwise obstruct the paper path.

Figure 8:
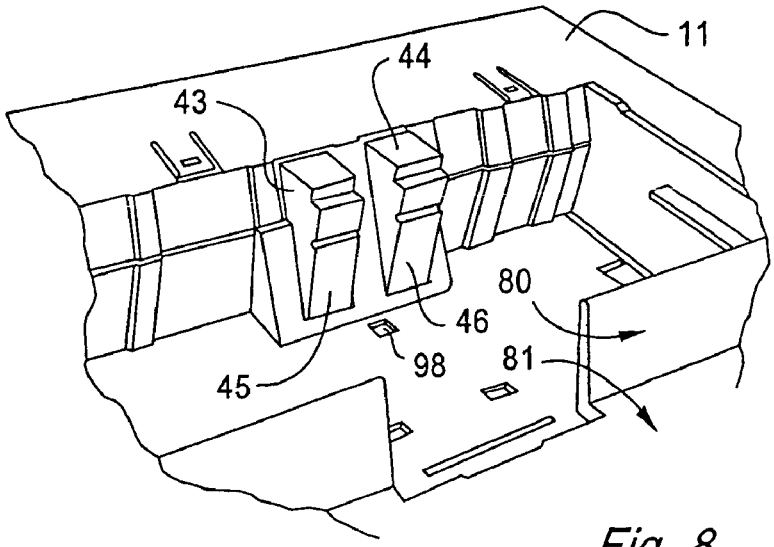
FIG. 8 shows a chassis incorporating a blocking mechanism according to the present invention in a position corresponding to FIGS. 5A and 5B.
Figure 9:
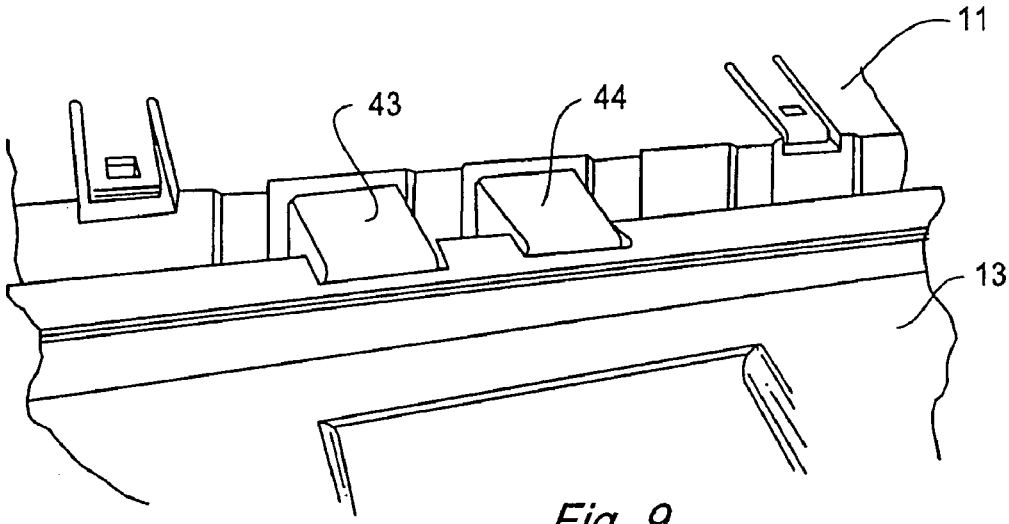
FIG. 9 shows a chassis incorporating a blocking mechanism according to the present invention in a position corresponding to FIGS. 6A and 6B.
Figure 10:
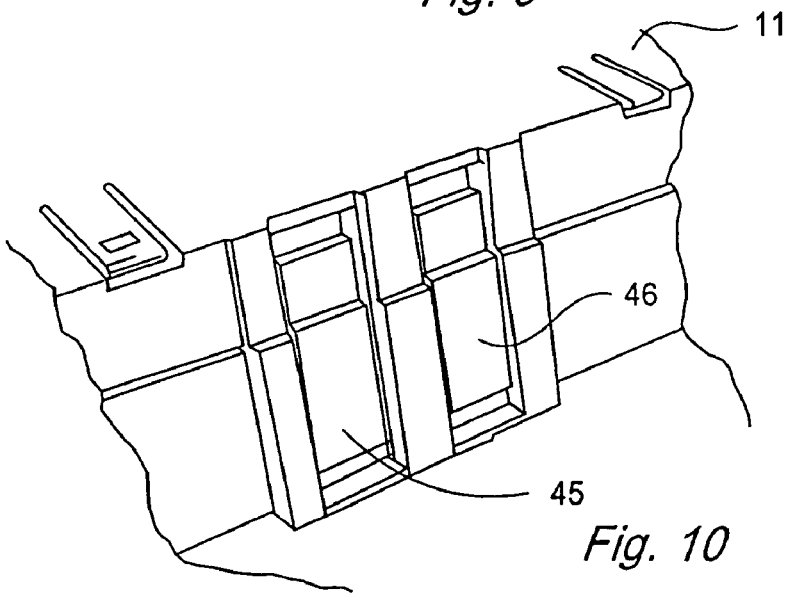
FIG. 10 shows a chassis incorporating a blocking mechanism according to the present invention in a position corresponding to FIGS. 7A and 7B.

To simplify the transmission mechanism and avoid using a lifting means, the cassette 12 includes a backwardly sloping rear wall 80 (refer FIG. 8). A sloping rear wall allows a relatively simple transmission mechanism to be used wherein the mechanism includes a single roller, to push the media back against the sloping rear wall 80 which subsequently deflects the media up the rear wall 80 and into the printer. When cassette 12 is inserted into chassis 13 above a certain force there is a tendency due to inertia, for the media to move up the sloping rear wall 80. This can cause the media to jam during transmission thereof to the associated printer.

Figure 4:
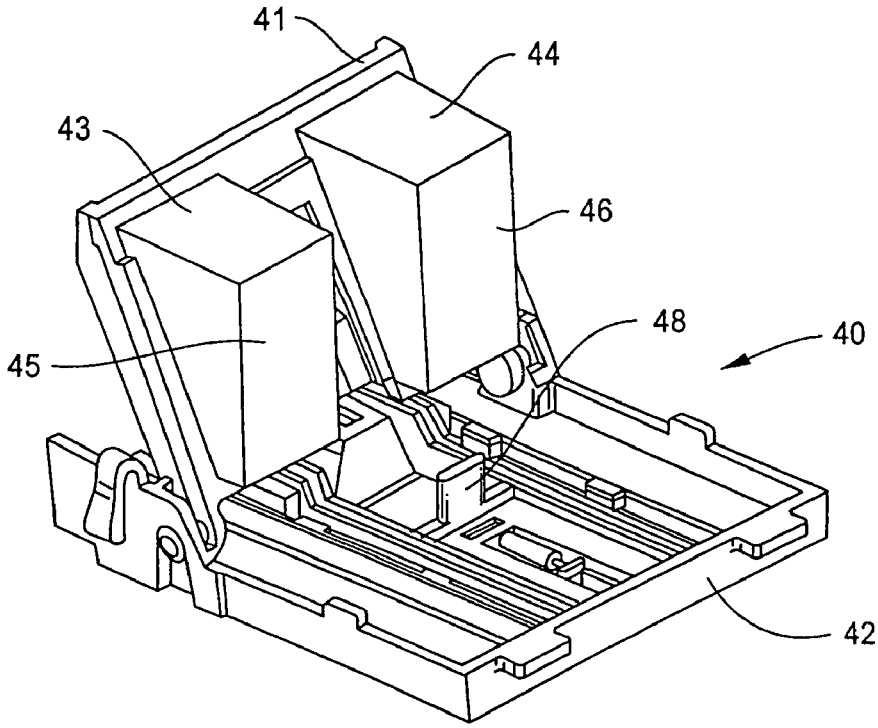
FIG. 4 shows a perspective view of a blocking mechanism according to the present invention.

In an embodiment a blocking mechanism may be fitted to tray body 11 for increasing the probability of correct transmission of imaging media. FIG. 4 shows a perspective view of the blocking mechanism 40. The blocking mechanism 40 includes a blocking door 41 pivotably mounted on a base 42. A pair of blocking elements 43, 44 is formed with or mounted on door 41. Blocking elements 43, 44 include blocking faces 45, 46 respectively. Door 41 pivots between a blocking position in which blocking faces 45, 46 project beyond the sloping rear wall 80 such that they are substantially normal to the floor 81 of cassette 12, and an inactive position in which blocking faces 45, 46 are substantially parallel, flush or recessed with respect to the sloping rear wall 80 of cassette 12.

The blocking mechanism 40 contains a trigger device including a retainer element 47 that is adapted to translate back and forth along a direction in which cassette 12 is inserted into chassis 13. Retainer element 47 includes a rib 48 at one end and a riser 49 at the other. When cassette 12 is inserted into chassis 13, it makes contact with rib 48 causing retainer element 47 to translate rearwardly relative to base 42. One end of a resilient element such as spring 50 is fixed to riser 49. The other end of spring 50 is fixed to a projection 51 on blocking door 41.

Blocking door 41 is mounted on base 42 such that it is biased to the blocking position at least when cassette 12 is being inserted into chassis 13. This is done by locating pivot axis 52 relative to the centre of mass of door 41 including blocking elements 43, 44, such that the weight of door 41 causes a rotating torque (anticlockwise in FIGS. 5A, 6A) that biases the door 41 to the blocking position. The pivot axis 52 is also positioned such that a force applied to blocking face 45, 46 substantially normally, such as by the media stack moving under inertia when cassette 12 is inserted into chassis 13, does not give rise to any appreciable rotating torque (clockwise in FIGS. 5A, 6A) that would dislodge it from the blocking position.

After a user places media into cassette 12 and slots it into chassis 13, a leading edge of cassette 12 contacts rib 48 and pushes it back along the media path. Even if cassette 12 is inserted above a certain force the media stack contacts the projecting perpendicular surfaces of blocking faces 45, 46 and is prevented from moving beyond blocking faces 45, 46. In this way the stack of media is effectively prevented from riding up sloping rear wall 80.

Figure 5A:
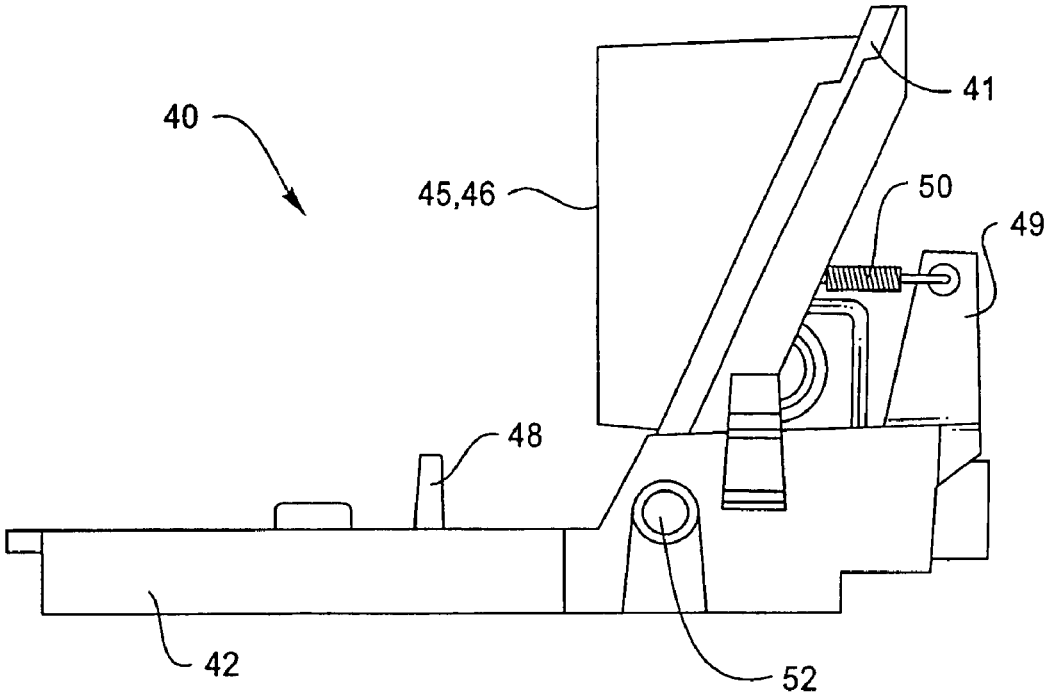
FIGS. 5A and 5B show side and rear perspective views respectively of the blocking mechanism in an unloaded position.
Figure 5B:
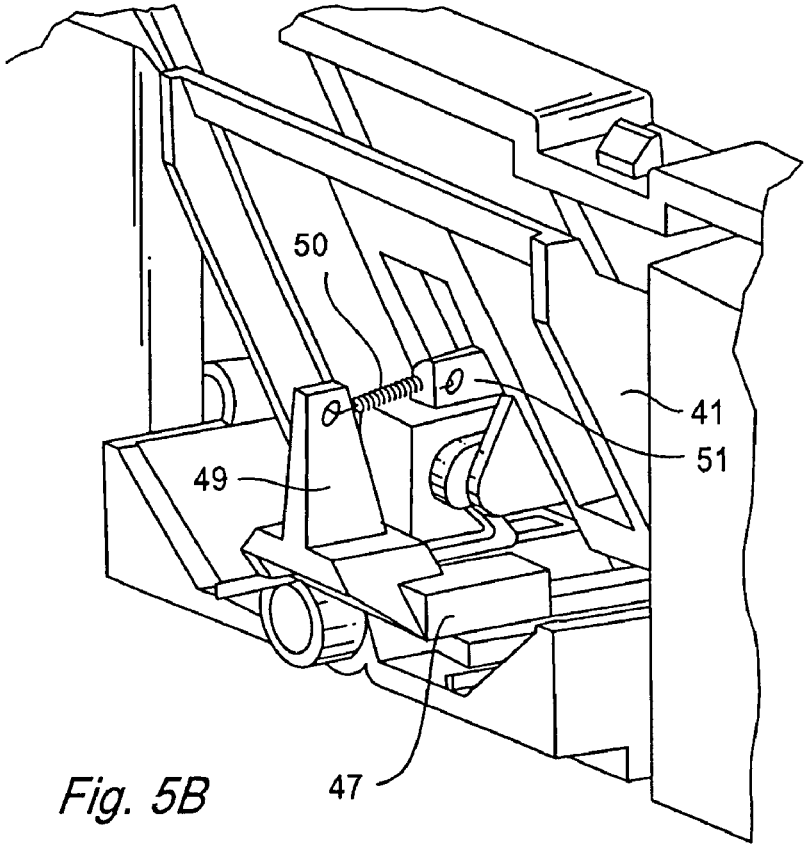
Figure 6A:
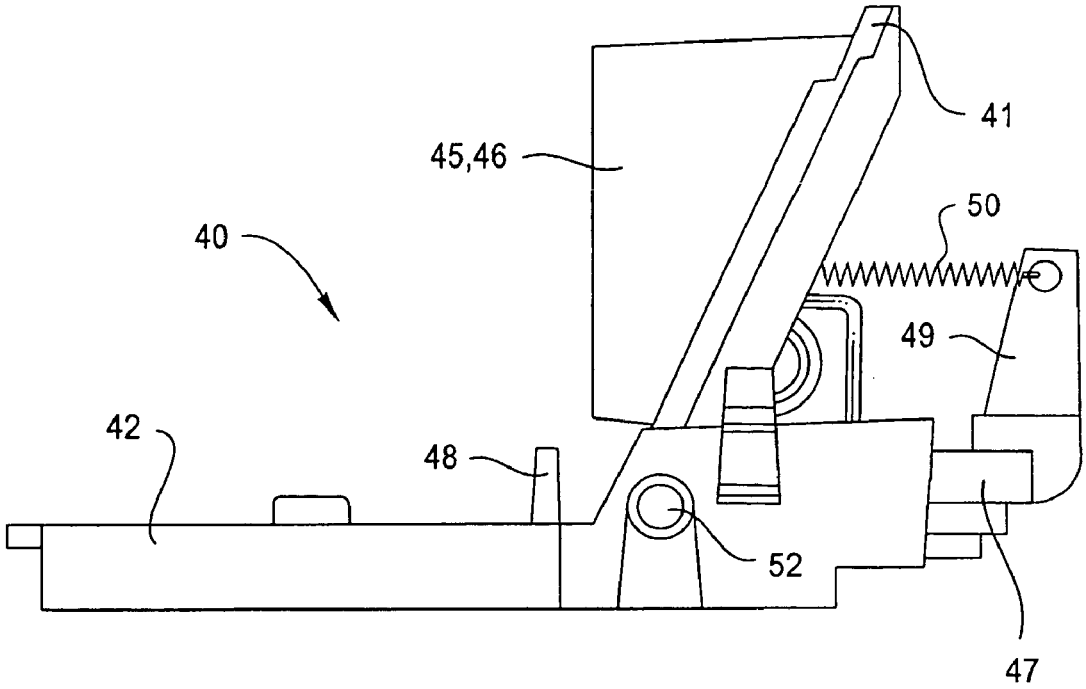
FIGS. 6A and 6B show side and rear perspective views respectively of the blocking mechanism in a loaded blocking position.
Figure 6B:
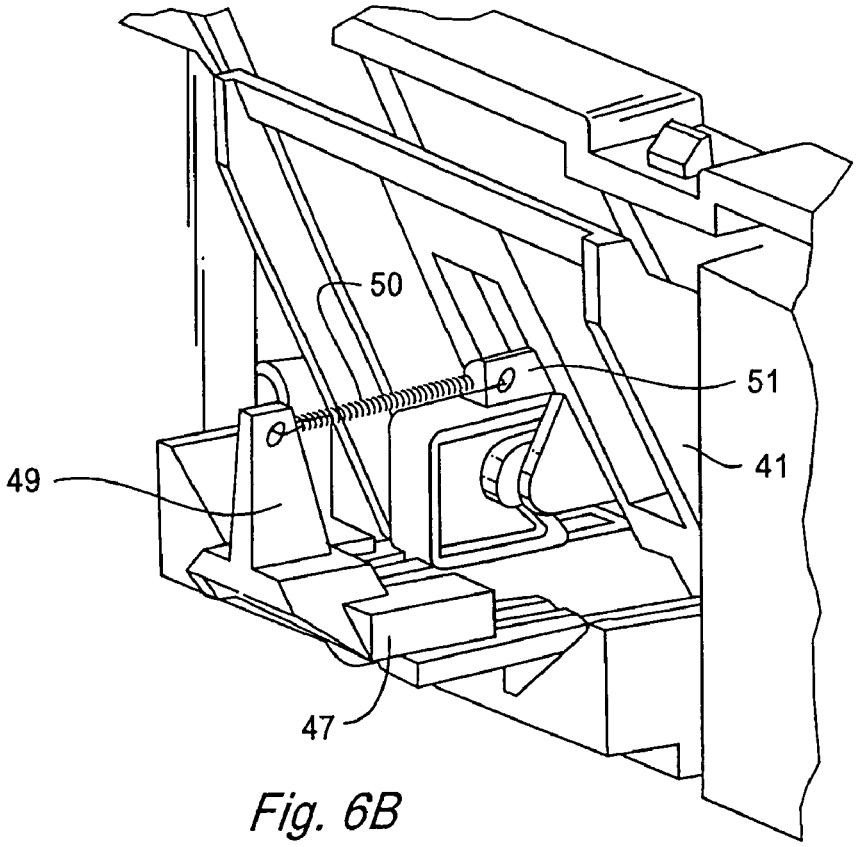
Figure 7A:
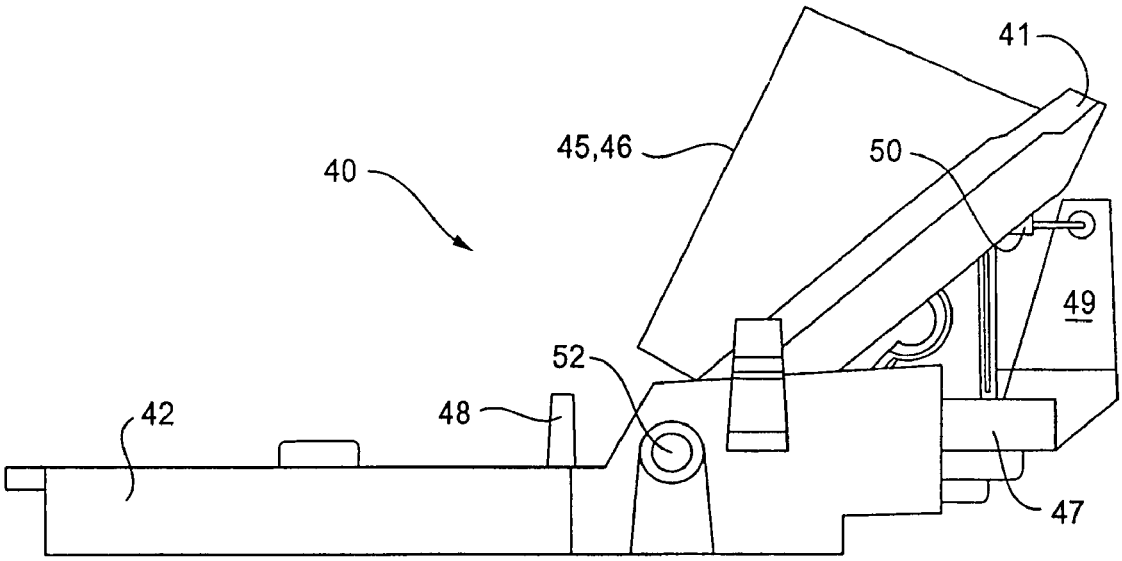
FIGS. 7A and 7B show side and rear perspective views respectively of the blocking mechanism in a loaded inactive position.
Figure 7B:
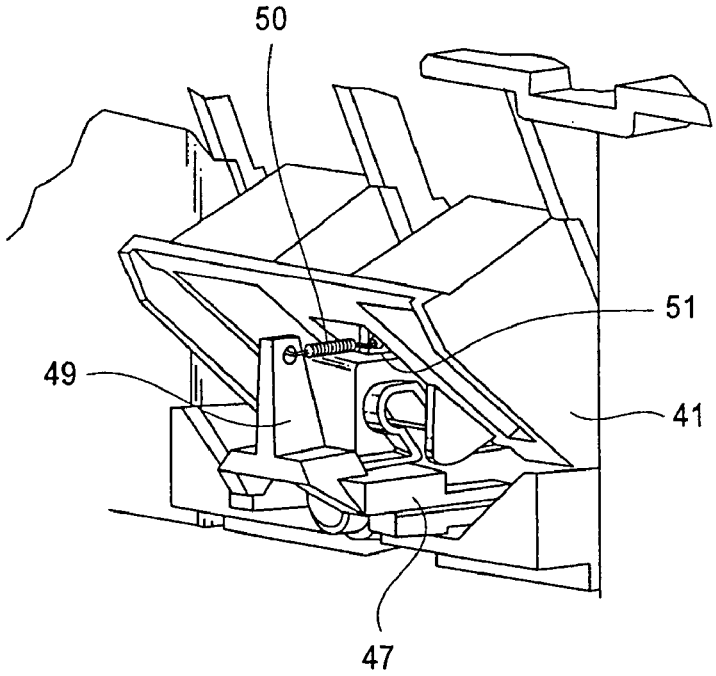

Meanwhile movement of rib 48 from the start position shown in FIG. 5A to the end of travel position shown in FIG. 6A causes retainer element 47 to be pushed to the end as well. This causes riser 49 to move to the position shown in FIGS. 6A and 6B and spring 50 to be elongated. Elongation of spring 50 exerts a pulling force on the blocking door 41 via projection 51 that overcomes frictional forces and its weight bias, and causes blocking door 41 to rotate to the inactive position shown in FIGS. 7A and 7B. The frictional forces and elongation of spring 50 act as a delay mechanism that delays rotation of the blocking door to the inactive position. This is exactly what is required to perform the blocking function and then a falling behind the sloping rear wall 80 of cassette 12 to clear a path for the media to move up into the associated printer.

Following loading of cassette 12 into chassis 13, the degree of delay prior to rotation of blocking door 41 to the inactive position may be adjusted by changing spring 50 to one having a heavier or lighter modulus of elasticity, and/or by applying dampening grease (Nye PG-44A Extra Heavy) to moving parts of the blocking mechanism to damp the falling action of blocking door 41 to the inactive position. If the steps triggering the falling action of blocking door 41 are allowed to happen too fast, the blocking faces 45, 46 may actually move to the recessed position before they have a chance to block the media.

Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An imaging media tray for an imaging system, said media tray including a media cassette having a sloping end wall, and-a blocking means having a blocking mode adapted to prevent imaging media from moving up said sloping end wall at least when said media cassette is being inserted into said imaging system, and an inactive mode to facilitate transmission of said media to said imaging system, wherein said blocking means adopts said inactive mode after said media cassette is inserted into said imaging system, said media tray further including means for moving said blocking means from the blocking mode to the inactive mode in response to said media cassette being inserted into said imaging system, and wherein said means for moving includes a retainer element movable between start and end positions.

2. An imaging media tray according to claim 1 wherein said blocking means includes at least one blocking element movable between blocking and inactive positions.

3. An imaging media tray according to claim 2 wherein said at least one blocking element is biased to said blocking position at least when said media cassette is being inserted into said imaging system.

4. An imaging media tray according to claim 3 wherein said at least one blocking element is mounted on a base such that the weight of said blocking element biases said blocking element to said blocking position.

5. An imaging media tray according to claim 2 wherein said at least one blocking element includes a blocking face that in said blocking position projects beyond said sloping end wall and in said inactive position does not project beyond said sloping end wall.

6. An imaging media tray according to claim 5 wherein in said blocking position said blocking face extends substantially normal to a floor of said media cassette.

7. An imaging media tray according to claim 2 wherein said retainer element includes a riser at one end thereof and wherein one end of a resilient element is connected to said riser and the other and of said resilient element is connected to said at least one blocking element.

8. An imaging media tray according to claim 7 wherein said resilient element is configured to delay movement of the at least one blocking element from the blocking position to the inactive position for a predetermined period of time following insertion of the media cassette into the imaging system.

9. An imaging media tray according to claim 1 wherein said retainer element includes a rib for abutting a leading edge of said media cassette when the latter is inserted into said imaging system.

10. In an imaging media tray including a media cassette having a sloping end wall, a method for preventing imaging media from moving up said sloping end wall at least when said media cassette is being inserted into an imaging systems said method including the steps of:

providing a blocking means having a blocking mode and an inactive mode;

setting said blocking means to said blocking mode at least when said media cassette is being inserted into said imaging system; and moving said blocking means from the blocking mode to said inactive mode after said media cassette is inserted into said imaging system to facilitate transmission of said media to said imaging system, wherein moving said blocking means from said blocking mode to said inactive mode includes moving a retainer element between start and end positions.

11. A method according to claim 10 wherein said blocking means includes at least one blocking element movable between blocking and inactive positions.

12. A method according to claim 11 including biasing said at least one blocking element to said blocking position at least when said media cassette is being inserted into said imaging system.

13. A method according to claim 12 including mounting said blocking element on a base such that the weight of said blocking element biases said blocking element to said blocking position.

14. A method according to claim 11 wherein said at least one blocking element includes a blocking face that in said blocking position projects beyond said sloping end wall and in said inactive position does not project beyond said sloping end wall.

15. A method according to claim 14 wherein in said blocking position said blocking face extends substantially normal to a floor of said media cassette.

16. A method according to claim 10 wherein said retainer element includes a rib for abutting a leading edge of said media cassette when the latter is inserted into said imaging system.

17. A method according to claim 11 wherein said retainer element includes a riser at one end thereof and wherein one end of a resilient element is connected to said riser and the other end of said resilient element is connected to said at least one blocking element.

18. A method according to claim 17 wherein moving a retainer element between start and end positions comprises delaying movement from the start position to the end position for a predetermined period of time following insertion of the media cassette into the imaging system.

19. An imaging media tray for an imaging system, said media tray comprising:

a media cassette having a sloping end wall, at least one blocking element movable between a blocking position adapted to prevent imaging media from moving up the sloping end wall at least when the media cassette is being inserted into the imaging system, and an inactive position adapted to facilitate transmission of said imaging media to said imaging system, wherein said at least one blocking element moves to the inactive position after said media cassette is inserted into said imaging system; and wherein the at least one blocking element is mounted on a based such that the weight of the at least one blocking element biases the at least one blocking element to the blocking position at least when the media cassette is being inserted into the imaging system.

20. An imaging media tray according to claim 19 further comprising:

a retainer element attached to the at least one blocking element through a riser and a resilient element, wherein said resilient element is configured to delay movement of the at least one blocking element from the blocking position to the inactive position for a predetermined period of time following insertion of the media cassette into the imaging system.

* * * * *

UNITED STATES PATENT AND TRADEMARK OFFICE

CERTIFICATE OF CORRECTION

PATENT NO. : 6,984,084 B2
DATED : January 10, 2006
INVENTOR(S) : Wei Kwan Ng et al.

It is certified that error appears in the above-identified patent and that said Letters Patent is hereby corrected as shown below:

Column 4,
Line 44, "the other and" should read -- the other end --;

Column 6,
Line 19, "based" should read -- base --.

Signed and Sealed this

Fourth Day of April, 2006

JON W. DUDAS
*Director of the United States Patent and Trademark Office*